United States Patent [19]

Stevens

[11] Patent Number: 4,571,755

[45] Date of Patent: Feb. 25, 1986

[54] FRAME SUPPORT FOR SOFA-SLEEPER

[75] Inventor: John E. Stevens, Carthage, Mo.

[73] Assignee: Leggett & Platt, Incorporated, Carghage, Mo.

[21] Appl. No.: 571,000

[22] Filed: Jan. 16, 1984

[51] Int. Cl.[4] ..... A47C 17/04

[52] U.S. Cl. ..... 5/13; 5/29

[58] Field of Search ..... 5/13, 29, 30, 31, 32, 5/33, 34, 35, 36, 28

[56] References Cited

U.S. PATENT DOCUMENTS

| | | | |
|---|---|---|---|
| 3,041,634 | 7/1962 | Willis | 5/13 |
| 3,247,526 | 4/1966 | Rogers | 5/13 |
| 3,281,871 | 11/1966 | Katz | 5/13 |
| 3,654,642 | 4/1972 | Barabas | 5/13 |
| 4,253,205 | 3/1981 | Mikos | 5/13 |

*Primary Examiner*—Alexander Grosz

*Attorney, Agent, or Firm*—Wood, Herron & Evans

[57] ABSTRACT

A bed frame for a sofa-sleeper including pivotally interconnected head, body, intermediate and foot sections, each having a pair of opposed side rails adapted to support an overlying link fabric frame and mattress, which are movable between a retracted position in which the bed frame is contained within the sofa frame of the sofa-sleeper and an extended position in which the bed frame extends outwardly to form a bed. The bed frame is provided with a U-shaped cross brace to enhance lateral stability which is pivotally mounted at each end to a side rail for pivotal movement between a position beneath the link fabric and mattress, in the extended position of the bed frame, so as to avoid contact with persons lying on the sofa bed, and a folded position wherein the cross brace is disposed immediately adjacent the link fabric with the bed frame in a retracted position within the sofa frame.

1 Claim, 12 Drawing Figures

FRAME SUPPORT FOR SOFA-SLEEPER

BACKGROUND OF THE INVENTION

This invention relates to a combination sofa-sleeper bed, and, more particularly, to a sofa of the type which includes a foldable bed having a head, body, intermediate and foot sections which are foldable and may be collapsed and hidden in the bottom of the sofa frame when the unit is used as a seating surface.

Sofa-sleepers generally comprise a four section foldable bed frame including pivotally interconnected head, body, intermediate and foot sections which are adapted to be folded between a fully folded or retracted position into a box-like sofa frame, and an extended position wherein the sections extend out and over the front rail of the sofa frame to form a bed. The head, body, intermediate and foot sections of the bed frame each include a pair of opposed side frame angles which are pivotally connected at their ends so that the sections are foldable or collapsable upon one another. The side frame angles support a wire frame or link fabric over which a mattress is placed for sleeping. The bed frame is supported vertically in an extended bed position by a plurality of foldable legs, and lateral support is provided by cross braces attached between the side frame angles of one or more of the four sections.

In prior art sofa beds, a lateral cross brace is typically connected between the side frame angles of the body section of the bed frame at a location where the chest and shoulders contact the bed in the prone position. The cross brace is welded or riveted in a fixed position to the side frame angles in substantially the same horizontal plane as the upper surface of the bed frame, just beneath the link fabric and mattress of the sofa bed which are supported by the side frame angles. It has been found that even with a relatively thick mattress the chest and shoulders are heavy enough to push downwardly and engage the cross brace when it is positioned just beneath the link fabric. Contact with the cross brace at the shoulders or chest is very uncomfortable and makes it difficult to obtain a restful night's sleep.

In order to avoid this problem, the lateral cross braces in some prior art sofa-sleepers have been formed with a crown or bow from end to end so that the middle portion of the cross brace is disposed approximately one inch below the link fabric mounted to the upper surface of the side frame angles. This has proved to be unsatisfactory because cross braces with only about a one inch bow can still be felt by persons lying prone on the extended sofa bed frame.

In order to avoid contact of the chest and shoulders with a lateral cross brace, it is necessary to dispose the cross brace at least about three inches beneath the link fabric mounted atop the side frame angles. In accordance with the teachings of the prior art, however, it is not possible to design a sofa-sleeper bed with a cross brace having a three inch bow which is welded or riveted in a fixed position at each end to the side frame angles. This is because the foldable sections of the bed frame must be permitted to collapse in a compact unit for insertion within the box-like sofa frame of the sofa-sleeper. A fixed cross brace extending three or more inches below the upper edge of the side frame angles would not clear the front of the box-like sofa frame as the foldable bed frame sections are collapsed therein. Even if the sofa frame were designed to avoid interference with the lateral cross brace, it would contact the floor when the bed frame sections are collapsed into the sofa frame unless the sofa frame was raised a proportional distance from the floor. Raising the height of the sofa seat is not an acceptable design alternative since it must be low enough to permit persons of average height to touch the floor when seated.

SUMMARY OF THE INVENTION

It is therefore an object of this invention to provide a cross brace adapted to be mounted between the side frame angles of a sofa bed frame which is not contacted by the chest or shoulders of a person lying on the bed frame, but permits folding of the collapsable bed frame sections into a standard sofa frame of the sofa-sleeper.

The lateral cross brace of this invention is U-shaped and includes a pair of spaced legs connected together by a transverse elongate tube. The free end of each leg is pivotally mounted to one of the side frame angles of the body section of the bed frame. In the extended position of the bed frame, the legs extend downwardly from and perpendicular to the side frame angles of the body section so as to dispose the transverse tube parallel to and approximately three inches below the link fabric mounted atop the side frame angles. In this position the U-shaped cross brace is not contacted by the shoulders or chest when a person lies on the extended bed frame.

A pair of spaced pivoting arms, each formed with a slot at one end, extend between respective legs of the cross brace and bed locking plates which are adapted to collapse and extend the center, vertical support legs of the bed frame as discussed in detail below. A pin is fixed to each leg of the cross brace, which is received within and slidable along the slots formed in the pivoting arms.

As mentioned above, in the extended position of the bed frame, the transverse tube of the cross brace is disposed generally parallel to and about three inches below the link fabric mounted atop the side frame angles of the body section of the bed frame. As the bed frame sections are folded on one another in preparation for retracting the bed frame for storage in the sofa frame, the pivoting arm pivots the cross brace about the pinned connections of its legs to the side frame angles so that the transverse tube is disposed substantially parallel to and adjacent the link fabric. This enables the now retracted bed frame sections to be received within the sofa frame without the lateral cross brace interferring with the front edge of the sofa frame or contacting the floor when the bed frame is fully collapsed into the sofa frame. The pivotal movement of the U-shaped cross brace is reversed, that is, its transverse elongate tube is pivoted to a position about three inches below the link fabric mounted atop the side frame angles, when the bed frame sections are placed in an extended position.

BRIEF DESCRIPTION OF THE DRAWINGS

The structure, operation and advantages of this invention will become further apparent upon consideration of the following description taking in conjunction with the accompanying drawings wherein.

DETAILED DESCRIPTION OF THE DRAWINGS

Figure 1:
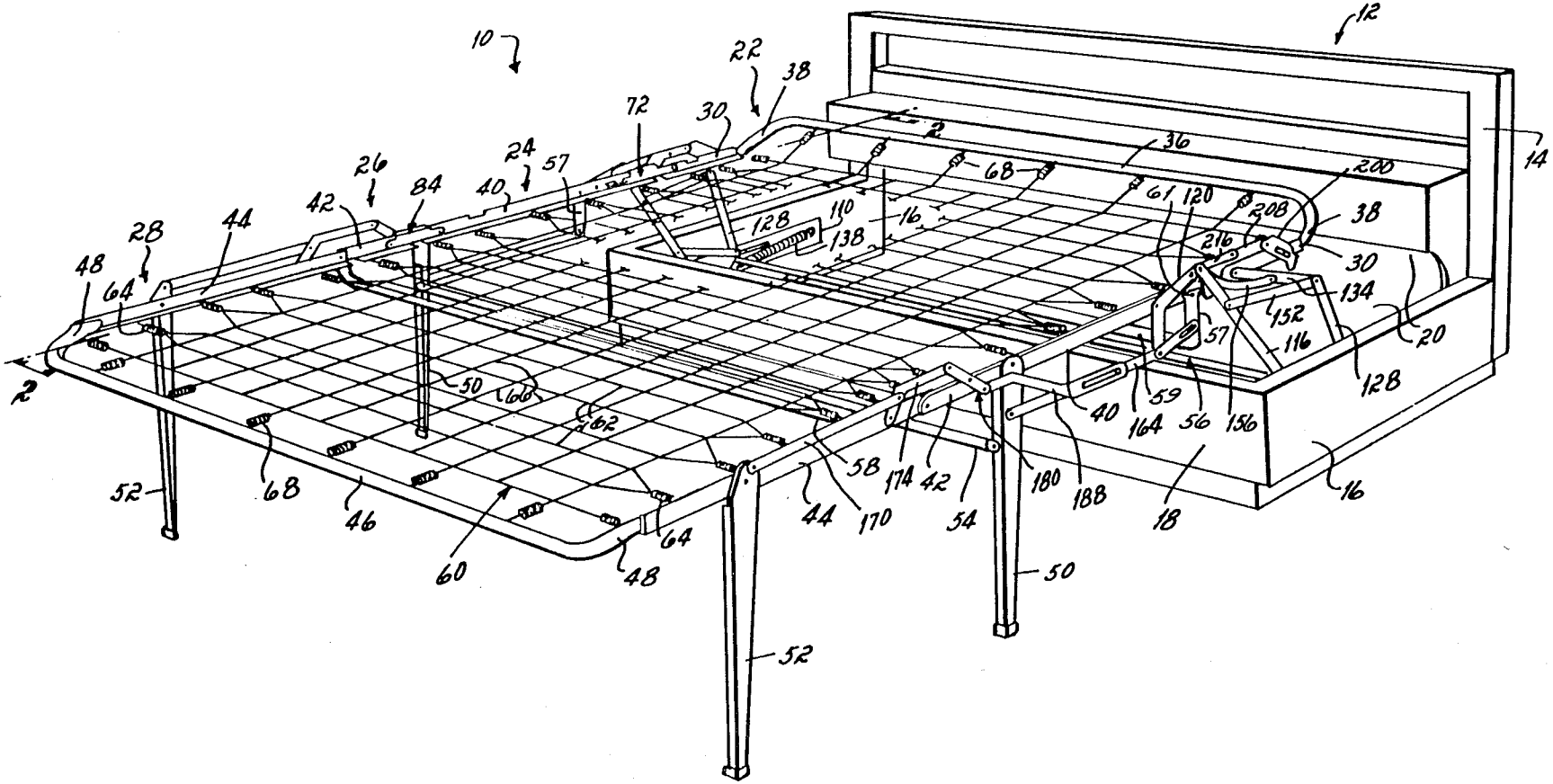
FIG. 1 is a perspective view of the foldable sofa-sleeper fixture embodying the invention of this application, the sleeper being shown in the extended bed position.
Figure 2:
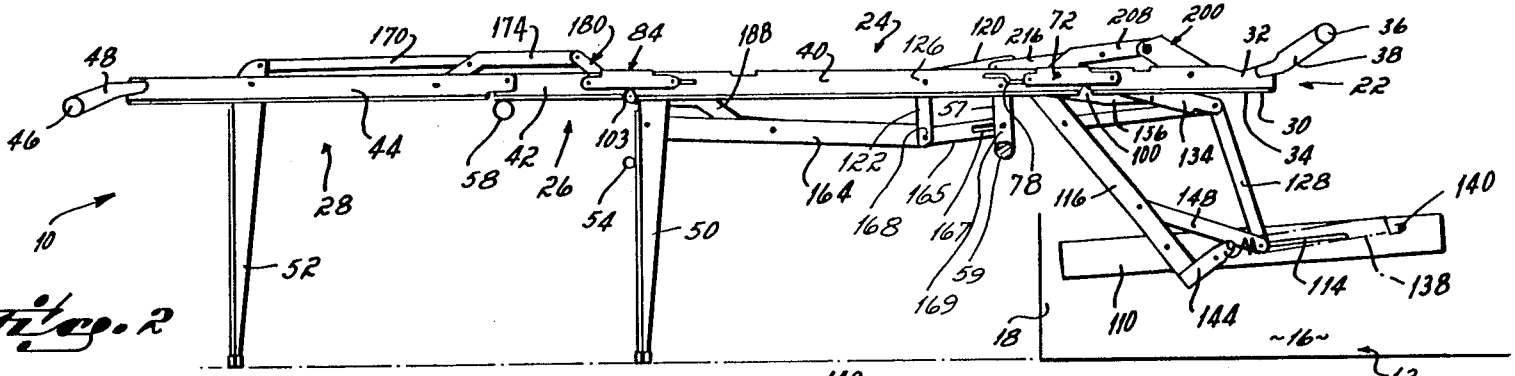
FIG. 2 is a side view taken along lines 2—2 of FIG. 1.

Referring now in detail to the drawings and particularly to FIGS. 1 and 2, it will be noted that the combination sofa-sleeper frame 10 is illustrated as being mounted upon a frame 12 of an upholstered sofa which has a back rest cushion 14, a pair of side rails 16, and a fixed front rail 18 which define a generally rectangular storage enclosure 20 for the folded bed frame 10. The sofa does not form any part of the invention of this application and may comprise any well known standard upholstered frame construction. As used herein, the terms "front" or "forward" end of the bed reference to that direction which is away from the sofa while the terms "rear" or "rearward" refer to a direction which is toward the sofa 12.

The foldable sofa-sleeper frame 10 comprises a rear head section 22, a long intermediate or main body supporting section 24 pivotally connected at one end to the head section 22, a short intermediate section 26 pivotally connected at one end to the other end of the long body section 24, and a front foot section 28 pivotally connected to the other end of the short intermediate section 26. The head section 22 comprises similar, symmetrically disposed left and right main angles 30 each having an outer vertical flange 32 extending up from an outer end of a lower inwardly extending horizontal flange 34. The rearward ends of the side angles 30 of the head section 22 are interconnected by cross member 36 which comprises a transverse tubular member bent at its ends to form arms 38 which are riveted to adjacent ends of the main angles 30.

The long intermediate or main body section 24, the short intermediate section 26, and the foot section 28 each comprise similar, symmetrically disposed left and right main angles 40, 42 and 44, respectively. A cross member 46 interconnects the forward ends of the foot section angles 44. The member 46 is similar to the cross member 36 and comprises a transverse tubular member bent at its ends to form arms 48 which are riveted to adjacent ends of the main angles 44. The long intermediate angles 40 serve to guide the folded frame 10 into the sofa enclosure 20 and therefore are sometimes referred to in the art as "pilot section" angles. For convenience of reference, angles 40 will be referred to hereinafter as pilot section angles 40.

The interconnected sections 22, 24, 26, 28 are supported in their extended position by a pair of foldable center support legs 50 pivotally connected at their upper end by rivets 51 to the forward ends of the pilot section angles 40 and a pair of foot sections supporting legs 52 pivotally connected at their upper end by rivets 53 to the foot section angles 44. A tubular cross member 54 interconnects the center legs 50 and is riveted at either end thereto to provide the legs 50 with lateral stability. If desired, a stabilizing member may be secured between the front legs 52 at their lower ends.

A U-shaped cross brace 56 extends between the left and right main angles 40 of the main body section 24, to provide lateral stability of the sofa-sleeper frame 10, particularly in its extended position. Cross brace 56 includes a pair of opposed vertical legs 57 connected together at one end by a transverse, elongate tube 59 which extends across the width of main body section 24. The opposite end of each vertical leg 57 is pivotally mounted by a pin 61 to respective left and right main angles 40. In the extended position of sofa-sleeper frame 10, the vertical legs 57 extend transverse to the main angles 40 so as to dispose the transverse tube 59 parallel to and approximately three inches below the horizontal plane passing through the main angles 40.

Preferably, the cross brace 56 is positioned along main body section 24 coincident with the point at which the shoulders or chest of a person lying on the sofa-sleeper frame 10 contact the main body section 24. The chest and shoulders are the heaviest parts of the body and create the most sag in the sofa-sleeper frame 10. However, with the elongate tube 59 of the cross brace 56 extending about three inches below the main angles 40, the shouders and chest do not contact the cross brace 56. This provides much more comfort in using the sofa-sleeper as a bed.

If desired, an additional cross brace 58 may be positioned between the left and right main angles 42 of the intermediate bed section 26. The cross brace 58 may be U-shaped and pivotally attached to main angles 42 in the same manner as cross brace 56 is attached to main angles 40. Alternately, the cross brace 58 is riveted in a fixed position to main angles 42, and formed without a crown or U-shape, as shown in the Figures. The illustrated configuration of cross brace 58 is perferred since the portion of the body which contacts intermediate bed section 26 is not as heavy as the shoulders and chest and does not cause sagging to the degree where contact is made with the cross brace 58.

Stretched between the side frame angles of the head, body, intermediate and foot sections of the frame is a continuous interconnected link fabric 60 or other means of conventional construction (See FIG. 1). The transverse wires 62 of the link fabric are resiliently connected to the side frame angles of the head, body, intermediate and foot sections by coil springs 64. The longitudinally extending wires 66 of the link fabric 60 are connected to the end cross tubes 36 and 46 by coil springs 68.

The interconnected sections 22, 24, 26, 28 together form a rectangular frame with curved corners when the bed frame 10 is fully pulled out. As may be seen in FIGS. 1 and 2, the sections lie in co-planar relation, i.e., they all lie on the same horizontal plane, and provide a resilient planar surface for supporting a mattress (not shown).

The foldable frames on both sides of the bed are similar and are symmetrically disposed. Since the means which connect the longitudinal portions of the bed frame on the right and left facing sides of the bed are similar and symmetrically disposed only the connections on one side will be described. The side of the frame shown in FIGS. 2–7 and FIG. 9 is the left facing side of the bed which is the side on the left side of a person standing in front of the foot of the bed and looking toward the head end of the bed.

The head section angle 30 is connected to the rearward end of the pilot section angle 40 by a rivet 70 and is cantilevered thereto by means of a locking strap 72 pivotally connected at 74 to the forward end of the head section angle 30, the opposite end of the strap 52 having a pin 76 slidable in a Z-shaped slot 78 in the rearward end of the pilot section angle 40. The strap 72 includes at its upper edge an outwardly extending horizontal flange 80 (See FIG. 3*a*) which engages the upper edges of the head and pilot section angles 30 and 40, respectively, in the fully extended position to prevent downward movement of the head section 22 with respect to the main body section 24 past a point where the head section 22 is co-planar with the main body section 24 (See FIGS. 2 and 2*a*).

Similarly, the forward end of the pilot section angle 40 is pivotally connected to the rearward end of the intermediate section angle 42 by a rivet 82. A second locking strap 84 having one end 86 pivotally connected to the intermediate section angle 42 and the other end making a pin 87 and slot connection 88 in the pilot section angle 40 is provided. The strap 84 has a like outwardly, horizontally extending flange 90 which engages the upper edges of the pilot section 40 and intermediate section 42 angles in the fully extended bed position (See FIG. 3*b*) to assure that the intermediate section is co-planar with the main body section in the bed position (See FIGS. 2 and 2*b*).

The foot section angle 44 is pivoted to the intermediate section angle by a rivet 92. No locking strap is used between these sections because the front support legs 52 provide the required support for a co-planar relation between sections 26 and 28, and a stud 175 protruding from the foot section angle 44 engages the arm 174 to level the foot section.

Figure 3A:
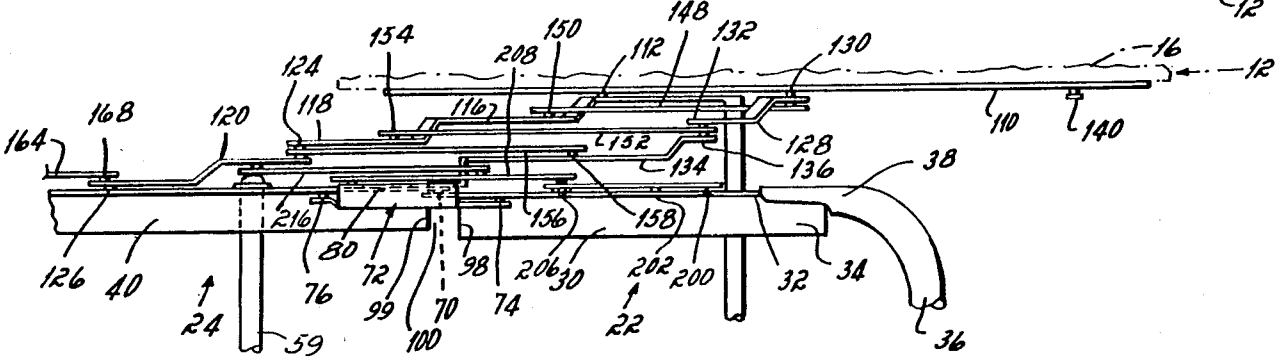
FIGS. 3*a* and 3*b* are top views of FIGS. 2*a* and 2*b* taken along lines 3*a*—3*a* and 3*b*—3*b*, respectively.
Figure 3B:
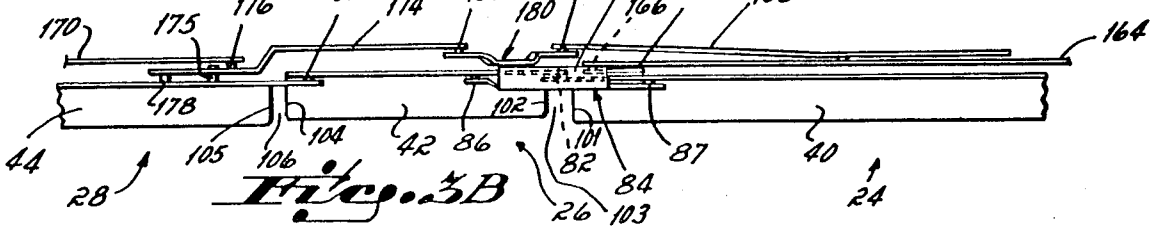

As may be seen particularly with reference to FIGS. 1 and 3*a* and 3*b*, the facing ends of the inwardly extending flange portions of the angles 30, 40, 42 and 44 forming the four sections 22, 24, 26 and 28, respectively, of the bed frame 10 are spaced one from another in the extended position of the bed frame 10. That is, the facing ends 98 and 99 of angles 30 and 40, respectively, are spaced one from another as at 100. The facing ends 101 and 102 of angles 40 and 42, respectively, are likewise spaced as at 103. And the facing ends 104 and 105 of angles 42 and 44 are similarly spaced as at 106. As may be seen, because the ends of the flanges are spaced, sheets or blankets cannot become pinched therebetween. Thus, the problem of pinching the loose edges of sheets or blankets, which are tucked under the mattress, between the articulated section as occurred in many prior art structures wherein the ends of the interconnected sections abut in the extended position has been eliminated by the foldable bed frame of the present invention.

In summary, the four section angles 30, 40, 42 and 44 are pivotally interconnected in end-to-end relation with the locking straps 72 and 84 and the legs 50 and 52 when unfolded cooperating to maintain the bed frame sections 22, 24, 26 and 28 in a co-planar horizontal position in the extended or sleeping configuration of the bed frame 10.

Figure 2A:
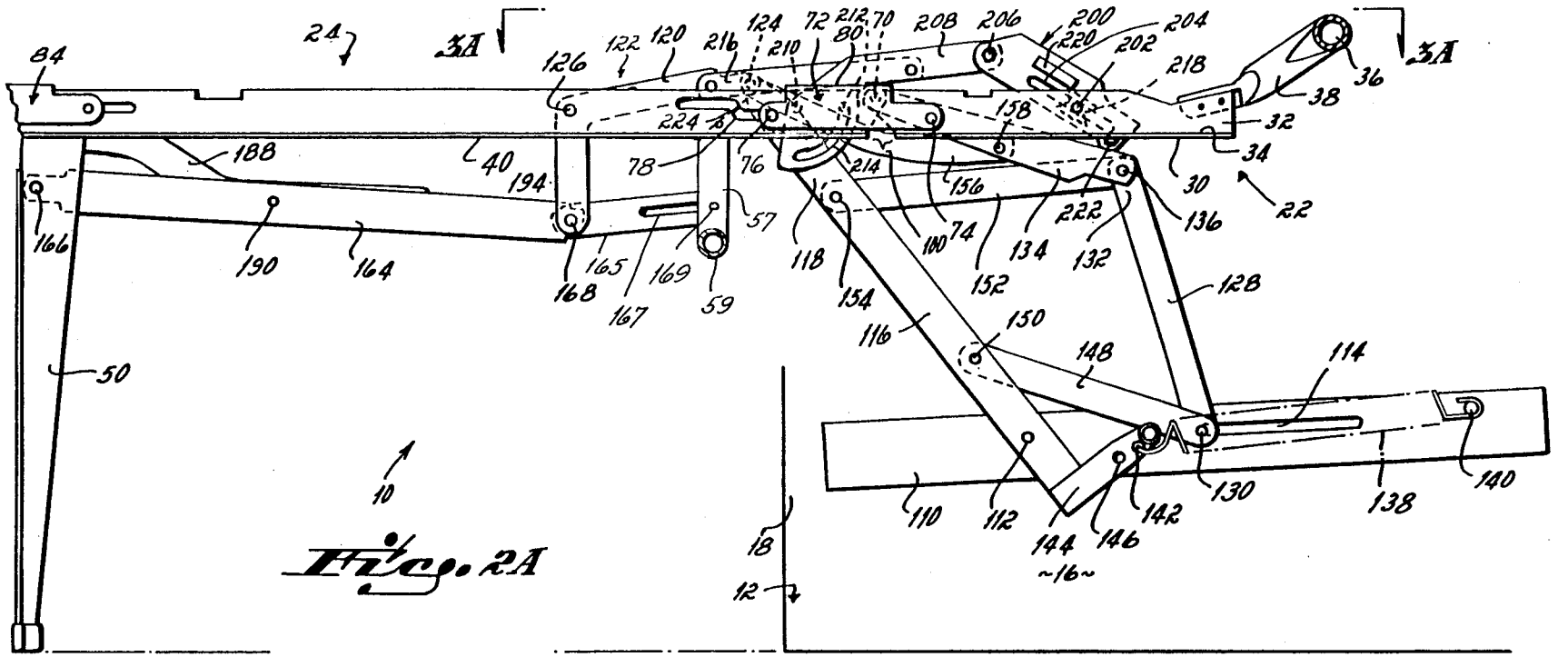
FIG. 2*a* is an enlargement of the rear half of FIG. 2 showing a side view of the head and main body sections.
Figure 2B:
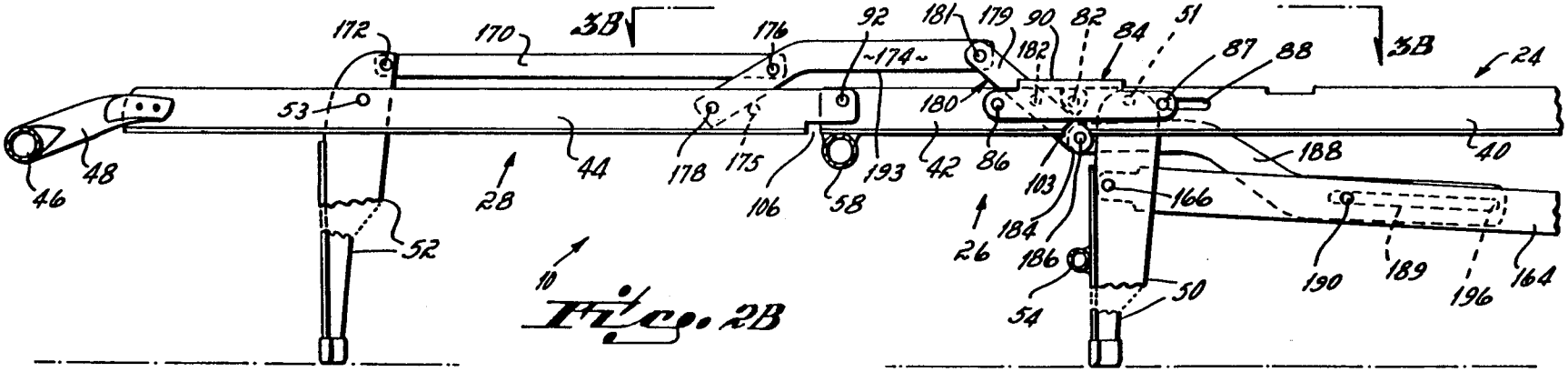
FIG. 2*b* is an enlargement of the forward half of FIG. 2 showing the foot section, the short intermediate section and a forward position of the main body section.

Referring specifically to FIGS. 2 and 2*a*, the foldable bed frame 10 is mounted and supported at its forward end with respect to the sofa 12 as follows. An anchor plate 110 is secured to the side rail 16 of the sofa frame 12 by suitable means such as bolts or screws (not shown). The anchor plate 110 includes a forward fixed pivot 112 and a slot 114 disposed rearwardly thereof in a generally horizontal orientation. A front support lever 116 is pivotally connected at its base with the fixed pivot 112 and its upper end 118 is pivotally connected to one arm 120 of a bed lock plate 122 by a single rivet 124. The bed lock plate 122 is in turn pivotally connected to the pilot section angle 40 by a single rivet 126. A rear support lever 128 has a pin 130 at its base making a sliding and pivoting connection with the slot 114 in the anchor plate 110. The upper end 132 of the rear support lever 128 is pivotally connected to one end of an upper rear support lever 134 by a single rivet 136. The opposite end of the upper rear support lever 134 is pivotally connected to the forwardmost end of the pilot section angle 40 by means of the pivot pin 70 interconnecting the pilot section angle 40 and the head section angle 30.

A coil tension spring 138 is fixed at its rearward end to the anchor plate 110 by a pin 140 protruding from the anchor plate, and its forward end passes through a hole 142 in an arm 144 rivets to the front support lever 116 at a point below the fixed pivot 112. The spring 138 biases the front support lever 116 to rotate in a counterclockwise direction about the pilot 112 (See FIG. 2*a*). This tension spring 138 assists in the opening of the sofa-sleeper unit and holds the frame 10 in a partially opened counterbalanced position.

A second hole 146 is provided in the arm 144 attached to the base of the front support lever 116 to provide an alternate position for attaching the coil spring to the arm 144. This permits different tensions to be placed on the spring in the fully extended or sleeping position of the bed to accommodate mattresses having different compressibilities. For example, when a coil spring mattress is used, the spring may be placed in the forward hold 146 whereas when a lighter, more compressible foam mattress is used, the rear hole 142 could be used.

The front support lever 116 and rear support lever assembly 128, 134 serve to lift the pilot section angle 40 out of the enclosure 20 in the sofa 12 to project it and thus the sections 42 and 44 articulated to it forwardly over the front rail 18. In the fully extended position shown in FIG. 2 and the partially folded position shown in FIG. 5, the rear or head end of the pilot section angle 40 is supported by these levers.

To control the movement of support levers 116, 128 and 134, a guide link 148 is pivotally connected at its forward end, as by a rivet 150, to the front support lever 116 at a point above the pivot 112 and at its rear end to the base of the rear support lever 128 by means of the pin 130 sliding in the slot 114 in the anchor plate 110. The guide link 148 causes sliding movement of the pin 130 in the slot 114 and, consequently, forward and rearward movement of the rear support lever 128 on rotation of the front support lever 116 about the pivot point 112.

The upper end 132 of the rear support lever 128 is connected to the front support lever 116 by a control link 152 which is pivotally connected at its forward end to the front lever 116 by means of a rivet 154. At its rearward end, the control link 152 is interposed between the upper end 132 of the rear support lever 128 and the lower end of the upper rear support lever 134. It is pivotally connected to both members 128 and 134 by the rivet 136. The control link 152 causes the rear support lever 128 to pivot about pin 130 as the front support lever 116 pivots about pivot point 112 and controls the position of the pivot 136 in folding and unfolding of the unit.

An actuating arm 156 is pivoted at its forward end on rivet 124 and is attached to the arm 120 of the bed lock plate 122 between the arm 120 and the upper end 118 of the front support lever 116. At its rearward end, it is pivoted to the upper rear support lever 134 by means of a rivet 158. The actuating arm 156 controls movement of the upper rear support lever 134 and positions the sofa-sleeper unit during folding and unfolding.

The actuating arm 156 is pivotally connected at its forward end to both the upper end 118 of the front support lever 116 and the arm 120 of the bed lock plate 122 by the single rivet 124. The bed lock plate 122 is in turn pivotally connected to the pilot section angle 40 by the pivotal connector or rivet 126. There is also a pin 160 which protrudes on the pilot section angle 40 of the bed frame 10 and through an arcuate slot 162 of the bed lock plate 122. This latter pin or rivet 160 limits the rotational movement of the bed lock plate 122 at an angle of approximately 105°.

As stated above, when extended into a bed position, the frame 10 is supported by the pair of foldable center legs 50 and the pair of foldable front legs 52. The center leg 50 is pivotally attached at its upper end (pivot 51) to the forwardmost end of the pilot section angle 40 and similarly the front leg 52 is pivotally attached (pivot 53) at its upper end to the foot section angle 44. When unfolded, these legs support the center and forwardmost ends of the frame in an unfolded or bed position.

To control folding of the center legs 50, a center leg actuating arm 164 is pivotally connected at its forward end, as by a rivet 166, to the center leg 50 and at its rear end to the bed lock plate 122. The connection between the bed lock plate 122 and the center actuating arm 164 is preferably by a rivet 168.

A pivoting arm 165 extends between the vertical leg 57 of U-shaped cross brace 56 and the bed lock plate 122. Pivoting arm 165 attaches to bed lock plate 122 at the rivet 168, and is formed with a slot 167 at its other end which receives a pin 169 mounted to the vertical leg 57 of cross brace 56. As discussed below, the pin 169 is slidable along slot 167 with the movement of pivoting arm 165 to pivot cross brace 56.

Figure 5:
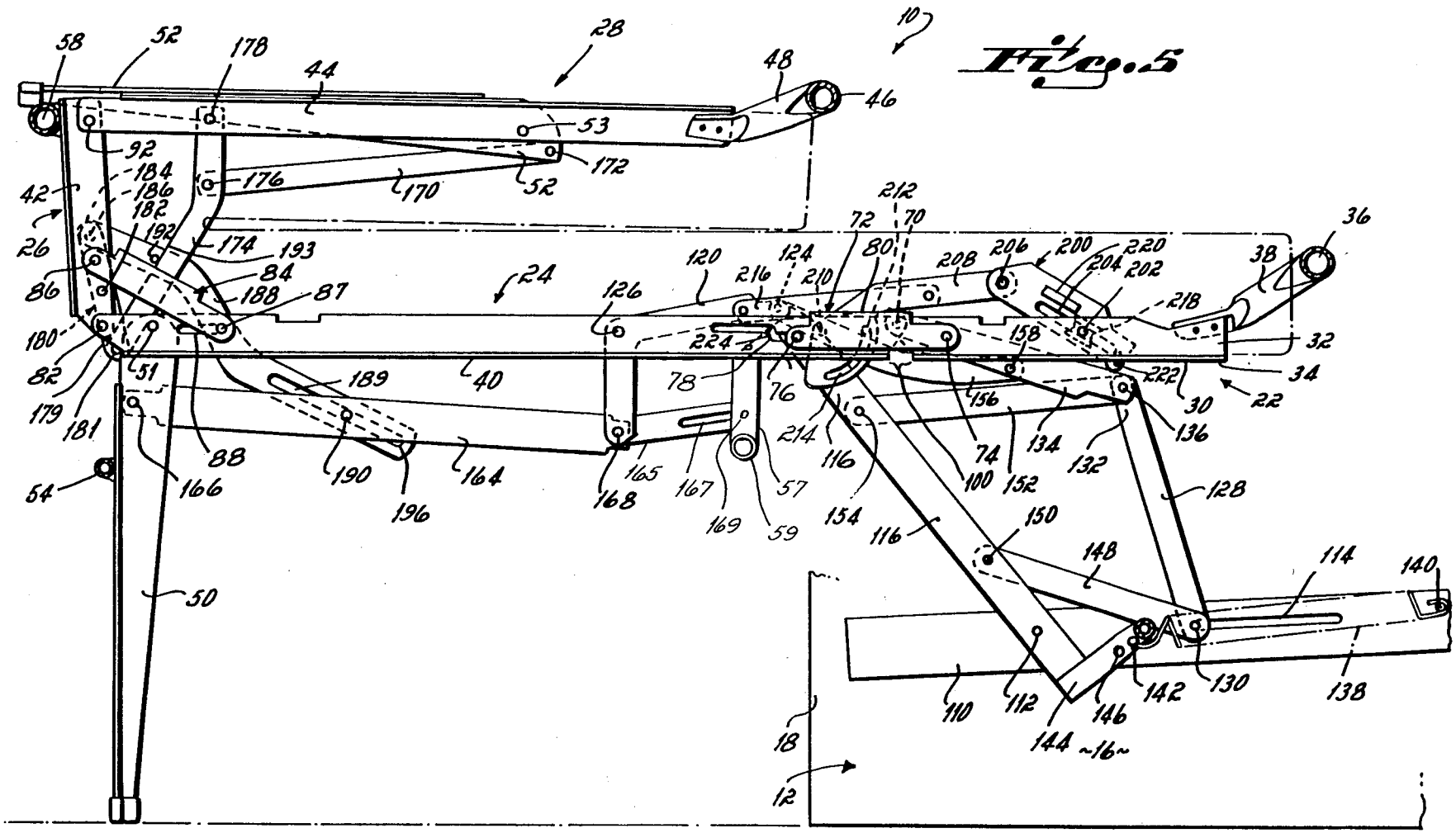
FIG. 5 is a side elevational view of the sofa-sleeper of FIG. 1 but with the foot section folded into overlying relation with the body section and illustrating the second step in folding the frame to a sofa position.
Figure 6:
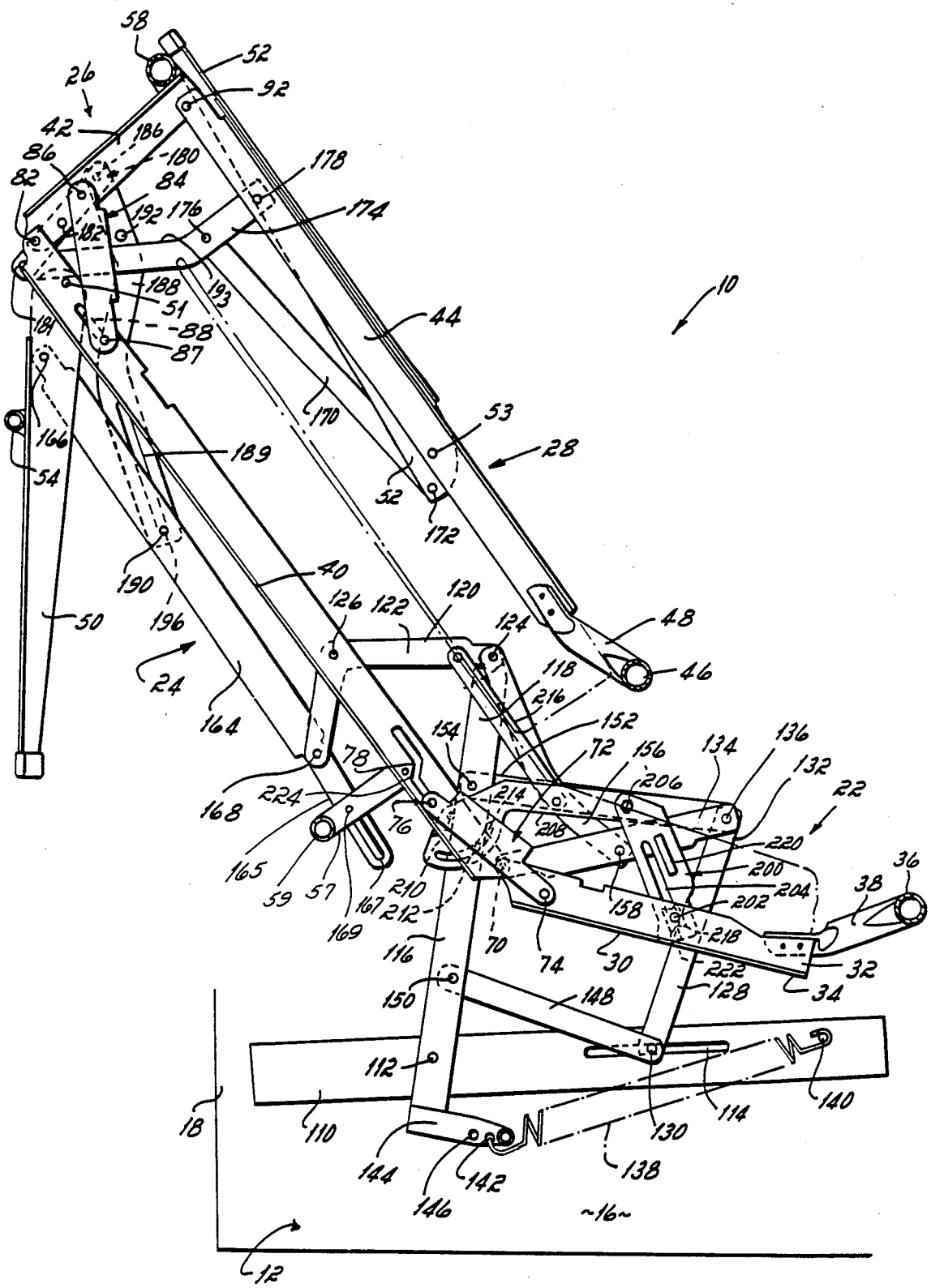
FIG. 6 is a side elevational view of the sofa-sleeper of FIG. 1 illustrating the next step in folding the frame to a sofa position.
Figure 7:
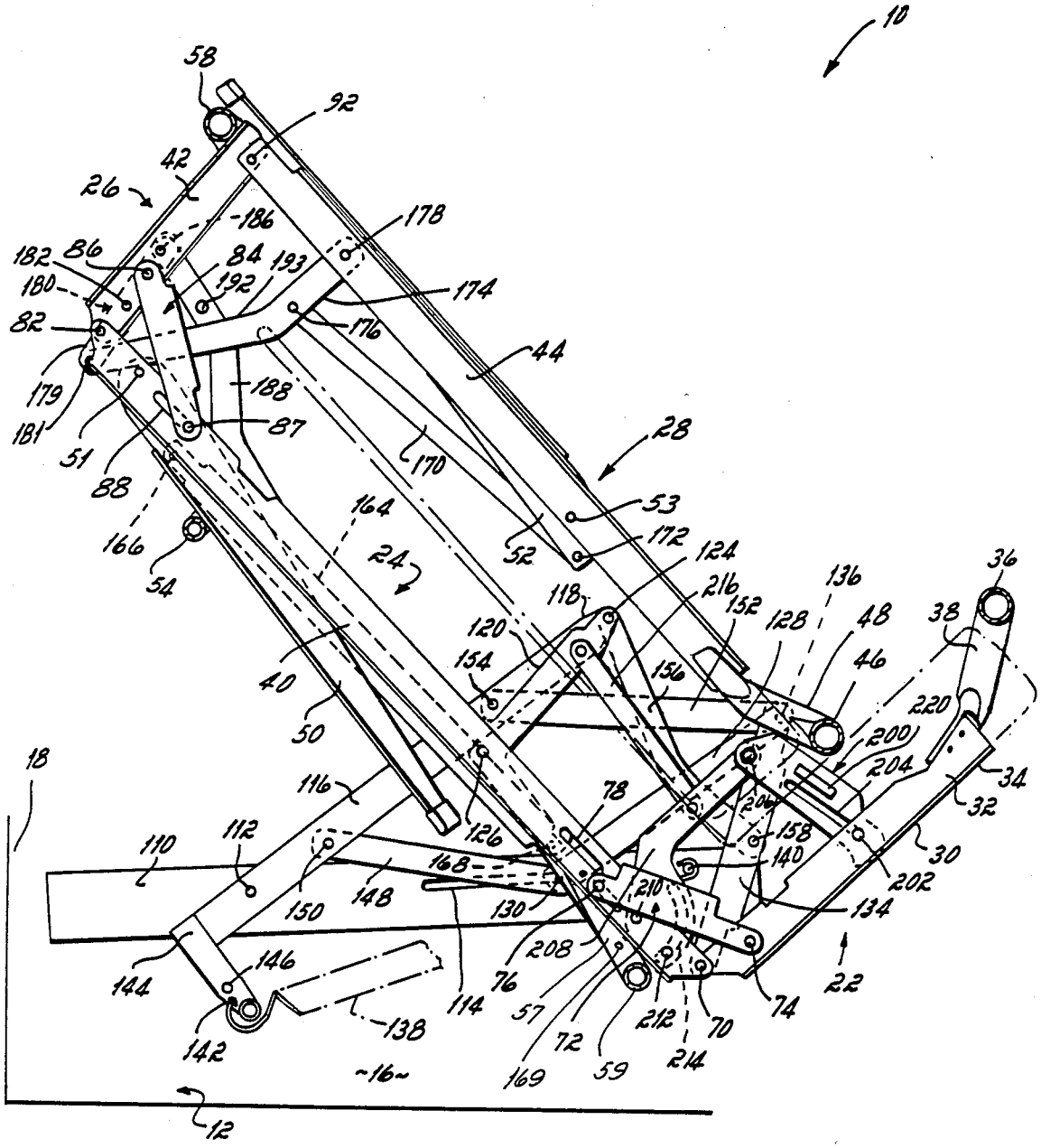
FIG. 7 is a side elevational view of the sofa-sleeper of FIG. 1 illustrating the final step in folding the frame to a sofa position.

As may be seen in FIGS. 5, 6 and 7, the center leg actuating arm 164 causes the center leg 50 to fold up under the pilot section angle 40 of the frame when the unit is collapsed from a bed to a sofa condition, and similarly the arm 164 causes the leg to be extended to a position normal to the body's pilot section angle 40 when the frame is unfolded to a sofa or bed condition. As set forth above, the legs 50 of the frame 10 are preferably interconnected by a cross brace 54.

To collapse the front leg 52 from a vertical position to a position in which it is generally parallel to the foot section angle 44 of the frame 10, an actuating arm 170 is pivotally connected at one end to the top of the leg as at 172 and is pivotally connected to a bell crank actuating arm 174 as at 176. The bell crank actuating arm 174 in turn is pivotally connected at its forward end to the foot section angle 44 as at 178 and at its rearward end to one arm 179 of a bell crank 180 as at 181. The bell crank 180 is pivotally connected to the rearward end of the intermediate section angle 42 by means of a rivet 182 (See FIG. 3*b*). The opposite arm 184, which lies 180° from the arm 179, is pivotally connected as at 186 to a compression arm 188. The opposite end of the compression arm has a slot 189 in which a pin 190 protruding outwardly from the center leg actuating arm 164 slides making a lost motion connection. The compression arm 188 includes a stud 192 which protrudes inwardly from the arm 188. This stud 192 engages the underside edge 193 of the bell crank actuating arm 174 when the foot section overlies the main body section (See FIG. 5) to prevent further rotation of the bell crank 180 in a clockwise direction.

Figure 4:
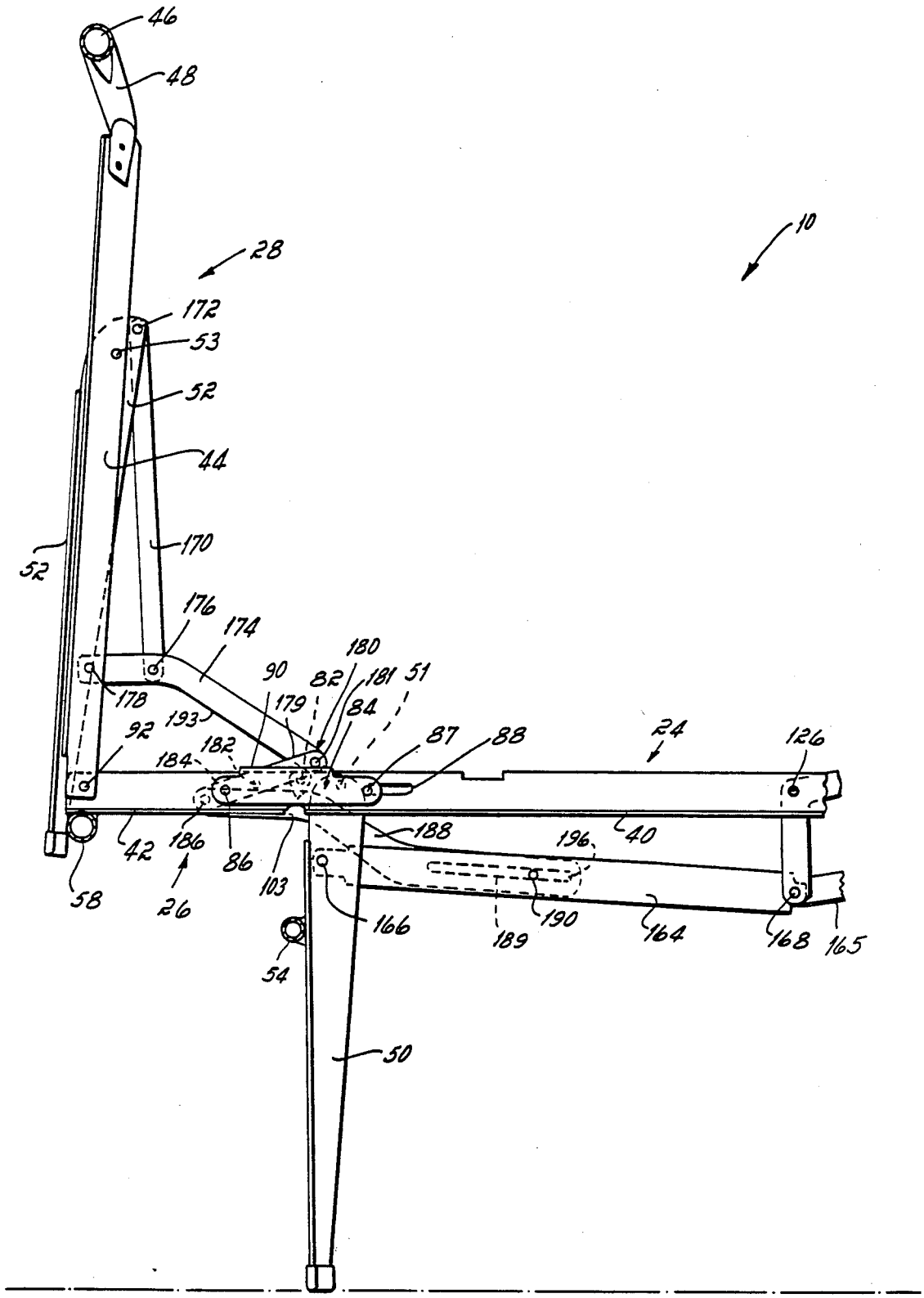
FIG. 4 is a side elevational view of a front portion of the sofa-sleeper of FIG. 1 but with the foot section partially folded.

As may best be seen in FIGS. 2 and 4, lifting of the foot section 28 of the frame 10 from a horizontal to a vertical position automatically causes the front leg 52 to be collapsed into a position in which it is substantially parallel to the foot section angle 44 and, similarly lowering the foot section automatically extends the leg 52 beneath the frame 10.

When the sofa-sleeper is fully extended, the foot section 28 of the frame 10 lies in a horizontal position supported by the leg 52. In this position, a stud 175 protruding outwardly from the foot section angle 44 engages the underside of the bell crank actuating arm 174 (See FIGS. 2*b* and 3*b*). This prevents the pivot point 92 from moving upwardly to prevent "jackknifing" of the two sections as could otherwise occur if someone were to sit on the extreme forward end of the foot section 28.

Movement of the foot section 28 into overlying relation with respect to the main body section 24 causes pivoting of the intermediate section 26 with respect to the pilot section angle 40 about pivot point 82. Pivoting continues until the pin 87 in the rearward end of the locking strap 84 reaches the rearward end of the slot 88 (See FIG. 5). At the point the pin 87 of the locking strap 84 engages the rear end of the slot 88 preventing any further rotational movement of the intermediate section 26 about the pivot 82, the intermediate section 82 of the frame has reached a position in which it is approximately perpendicular to the body section 24 and the foot section 28.

This same linkage, including the bell crank actuating arm 174, the bell crank 180 and the compression arm 188 also serve to lock the foot section 28, the intermediate section 26 and the body section 24 of the frame in the fully collapsed condition when the frame is completely folded into a sofa position. To this end, it will be noted in FIGS. 5–7, that as the frame moves from the position illustrated in FIG. 5 to that illustrated in FIG. 7, the bed lock plate 122 rotates in a counterclockwise direction as viewed in these figures until the pin 160 engages the lowermost end 194 of the slot 162. This rotational movement of the bed lock plate 122 causes the center leg actuating arm 164 to be moved downwardly and rearwardly until the pin 190 protruding therefrom engages the rearward end 196 of the slot 189. At this point (See FIG. 6), the foot section 28 cannot be raised since counterclockwise rotation of the bell crank 180 is prevented by the compression arm 188. In this position, a folded mattress (shown in phantom in FIG. 5) between the foot section 28 and the body section 24 is fully compressed therebetween. In this locked condition, the mattress between the two sections 24 and 28 of the frame 10 forms a rearwardly sloping seat for the sofa and one which does not collapse or give when a person sits down upon it (See FIG. 9). Moreover, in this locked compressed condition, the resiliency of the mattress will be prevented from raising the seat (foot section) upwardly when a person gets up from his seat on the sofa.

The head section 22 of the frame 10 has the capability of being raised to a locked, inclined position relative to the body section 24 to form an upper back and head rest for watching TV, reading and the like.

This capability is achieved by providing a TV slotted link 200 which is pivotally connected to the head section angle by means of a pin 202 slidable in a slot 204 in the slotted link 200. The other end of the slotted link 200 is connected by means of a pin 206 to the rearward end of a TV support link 208. The opposite end of the TV support link 208 is pivotally connected to the pilot section angle 40 by means of a pin 210. A second pin 212 protrudes outwardly from the pilot section angle 40 and moves in an arcuate slot 214 in the forward end of the TV support link 208. A TV control link 216 is pivoted at its rear end to the TV support link 208 and at its forward end to the arm 120 of the bed lock plate 122. A butterfly member 218 is pivotally mounted on the pin 172 between the outside of the head section angle 30 and the inside of the TV slotted link 200. The TV slotted link 200 further includes a lug 220 engageable with the butterfly member 218 to lock the head section 22 in an inclined position with respect to the body section 24 and an actuating lug 222 for moving the butterfly into and out of latching relationship with the lug 220. The operation of the butterfly 218 and lugs 220 and 222 is conventional and need not be described in detail. Briefly, the operation is sequential in that to move the head section 22 to the inclined TV position the operator first grasps the cross member 36 to rotate the head section 22 toward the body section 24. On rotation, the lug 220 first rotates the butterfly 218 into position for actuation by the lug 222. The head section is then pulled back slightly. The actuating lug 222 now rotates the butterfly for latching with the lug 220. To release the head section, it is again pulled forwardly whereby the lug 222 again rotates the butterfly member 218 out of position for latching engagement with lug 220. The head section may now be dropped to a horizontal position. In so doing, the lug 220 rotates the butterfly 218 into proper orientation for the subsequent raising and latching sequence.

The shoulder 224 in the Z-shaped slot 78 prevents the pin 76 and consequently the head section 22 from sliding forwardly in the position shown in FIG. 7 which otherwise could permit undesired rotation of the butterfly 218 and thus improper sequencing of the butterfly when operated without a mattress providing the resiliency to hold the head section in place.

In one presently preferred form of the invention, the connection of the forward end of the TV slotted link 200 to the rearward end of the TV support link 208 at 206 is not made until the bed frame 10 is assembled into the sofa frame 12. This permits the head section 22 to be interposed between the body section 24 and the foot section 28 in the fully folded position of the frame 10 to form a more compact package for shipping (shown in phantom in FIG. 9). During manufacture of the sofa-sleeper, the manufacturer installs a rivet 206 to connect the TV slotted link with the support link 208.

OPERATION

The folding sequence in which the frame 10 converts from a bed as illustrated in FIGS. 1 and 2 to a sofa is illustrated in FIGS. 4–9.

Referring first to FIGS. 2 and 4, it will be seen that the first step in the folding of the bed is to lift the front tubular cross member 46 until the foot section 28 of the frame is located in a position just past a vertical plane (See FIG. 4). As a consequence of this movement, the front leg 52 is caused by the actuating arm 170 to fold to the foot section angles 44.

Continued pushing against the cross member 58 causes the frame to pivot about the pivot point 82 connecting the intermediate and pilot section angles 42 and 40, respectively, thereby lifting the intermediate section 26 of the frame into a vertical condition (See FIG. 5). In the vertical condition of the intermediate section 26 of the frame, the forward end of the mattress is completely folded over upon itself to a double thickness as shown in phantom in FIG. 5. When the intermediate section 26 of the frame reaches the vertical position, the foot section 28 is then located in a horizontal plane over the top of the double thickness mattress. The intermediate section 26 is precluded against continued rotational movement about the pivot 82 by the pin 87 engaging the rear end of the slot 88.

Continued folding movement of the frame is then effected by lifting the tubular member 58 upwardly so as to lift what is now the front of the partially folded frame including the center leg 50 upwardly as illustrated in FIG. 6. At the time the operator grasps the member 58 to lift the partially folded bed frame, the front legs 52 have been fully collapsed into engagement with the foot section angles 44. Thus, there is no possibility of the operator's hands when grasping the tube 58 in the vicinity of the legs 52 of being pinched between the legs 52 and the angles 44. The upward movement of the front of the frame causes the front support lever 116 to rotate about its lower pivot 112; and, simultaneously, the bed lock plate 122 to rotate in a counterclockwise direction as viewed in FIG. 6. Simultaneously with the counterclockwise rotation of the bed lock plate 122, the center leg actuating arm 164 is moved rearwardly completely collapsing the center legs 50 beneath the body section 24 of the frame.

In addition, the pin 190 protruding from the center leg actuating arm 164 reaches the rearward end 196 of slot 189 thereby pulling the compression arm 188 in a rearward direction. Compression arm 188 pivots the bell crank 180 about its pivot point 182 until the pin 190 engages the end 196 of the slot 191. This locks the foot section 28 in fixed relation to the body section 24 to prevent the resiliency of the mattress from pushing the foot section upwardly, as described above.

Counterclockwise rotation of the bed lock plate 122 also causes the cross brace 56 to pivot. As shown in FIGS. 1–2*a*, the vertical legs 57 of cross brace 56 extend downwardly and are transverse to the main angles 40 of main body section 24 with the sofa-sleeper frame 10 in an extended position. The elongate tube 59 connecting the legs 57 of cross brace 56 is thus disposed generally parallel to and beneath the horizontal plane passing through the link fabric 60 mounted atop the left and right main angles 40. In the extended position of frame 10, the pivoting arm 165 is positioned so that the pin 169 mounted to the vertical leg 57 of cross brace 56 is seated at or immediately adjacent the rearward end of the slot 167 formed in the pivoting arm 165.

As discussed above, in order to collapse sofa-sleeper frame 10 so that it can be received within the sofa frame 12, cross brace 56 must pivot upwardly toward the main angles 40 so that its vertical legs 57 and elongate tube 59 do not contact the forward edge of the sofa frame 12 or the floor when the sofa-sleeper frame 10 is received within the sofa frame 12.

Referring to FIGS. 6–9, the pivotal movement of cross brace 56 is illustrated. Upward movement of the front of the intermediate and main body sections 24, 26 causes the bed lock plate 122 to rotate in a counterclockwise direction. Since one end of the pivoting arm 165 is connected to bed lock plate 122 at rivet 168, the pivoting arm 165 is moved rearwardly so that the pin 169 mounted to the vertical leg 57 of cross brace 56 slides to the forward end of the slot 169 in pivoting arm 165. Continued counterclockwise rotation of bed lock plate 122 urges the pivoting arm 165, and, in turn, the cross brace 56 rearwardly. The cross brace 56 pivots about its connection to the main angles 40 so that the vertical legs 57 move from a position transverse to main angles 40 to a position substantially parallel to and adjacent the main angles 40. The cross brace 56 is therefore folded or pivoted upwardly alongside the main angles 40 so as not to obstruct the movement of sofa-sleeper frame 10 into the sofa frame 12. The movement of cross brace 56 is simply reversed in lifting the sofa-sleeper frame 10 from the sofa frame 12 and placing it in an extended position.

Simultaneously with the lifting of the front of the partially collapsed frame, the rear end of the pilot section angle 40 is lowered and moved to a rearward position as illustrated in FIG. 6. Rotation of the bed lock plate 122 causes the TV control link 216 acting through the TV support link 208 to pull the TV slotted link 200 in an upward and forward direction. This action pulls the head section 22 into an inclined position with respect to the body section 24 preparatory to the head section of the frame being moved up into a cavity in the back rest cushion 14. On further movement of the folded frame, the head section continues to rotate until the pin 212 engages the end of slot 214 in the TV support link. At this point, the head section 22 is perpendicular to the body section 24 (See FIG. 7).

As may be seen in FIG. 6, rotation of the bed lock plate 122 and the front support lever 112 have caused the rear support lever 116 to move rearwardly (the pin 130 sliding rearwardly in the slot 114) and to pivot about pin 130 in a clockwise direction. After the frame has reached the position in FIG. 6, pushing against the front tube 58 causes the pin 130 to continue to move rearwardly in the slot 114 until it contacts the rearward end of the slot 114. Movement of the control link 152 in response to pivotal movement of the front support lever 116 also causes the rear support lever 128 to pivot rearwardly. In this orientation, the bed lock plate 122 has rotated the full counterclockwise distance permitted by the pin 160 moving in the arcuate slot 162 to retract the legs 50. In the course of this movement, the head section 22 is caused to move from its generally horizontal to its vertical position about the pivot point 70. When the head section 22 finally reaches the vertical position, it is located completely within a cavity contained within the back rest of the sofa.

Figure 8:
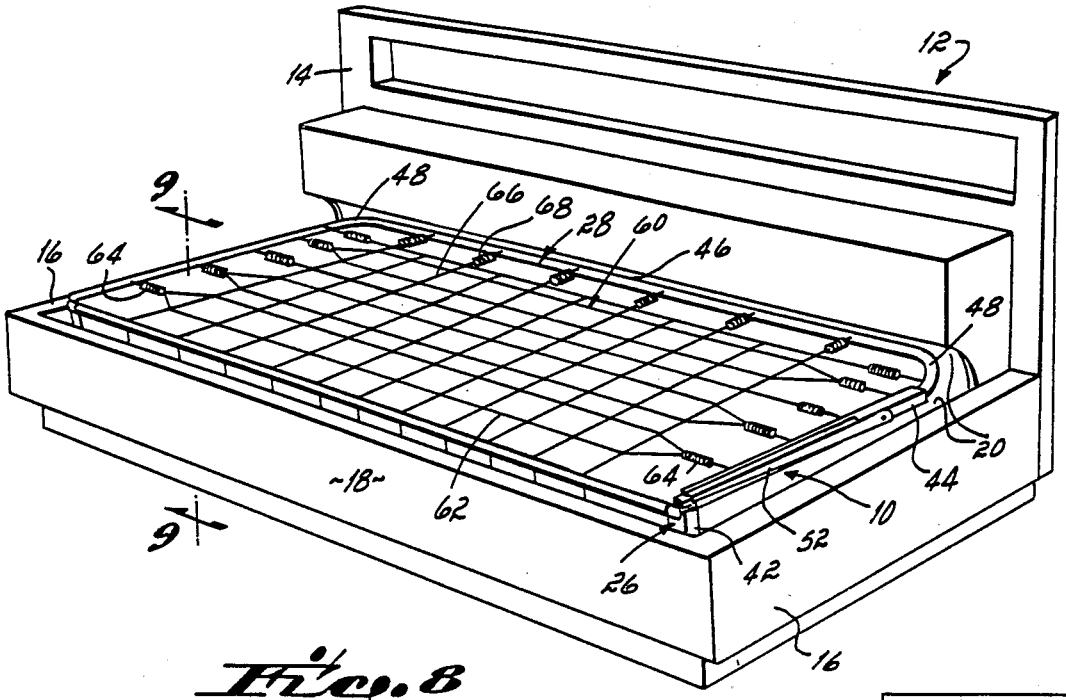
FIG. 8 is a perspective view showing the frame in its completely folded sofa position.
Figure 9:
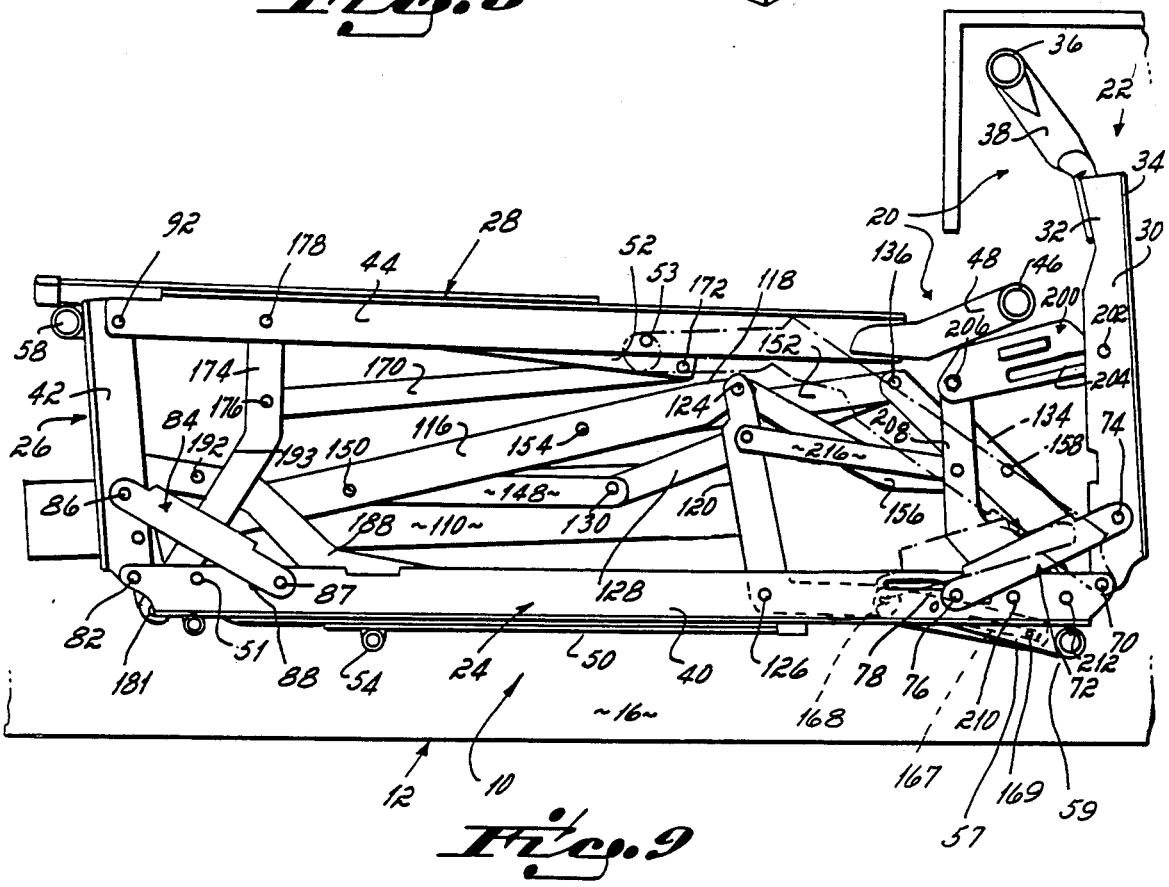
FIG. 9 is a view taken along line 9—9 of FIG. 8.

Referring now to FIGS. 8 and 9, it will be seen that in the collapsed or folded sofa position, the main body section 24 lies in a horizontal plane at the bottom of the sofa frame with the foot section 28 overlying it and forming the seat of the sofa. The intermediate section 26 is in a vertical orientation behind the front rail 18. The head section 22 is in a vertical position behind the back 14 of the sofa.

To extract the folded bed frame from the storage enclosure 20 to form an unfolded bed, the procedure described above is reversed. Briefly, the operator grasps the tubular member 56 and pulls the folded frame upwardly and outwardly over the front rail 18. The tension spring 138 which in the collapsed position is in tension serves to aid counterclockwise rotation of the front support lever 116 about the pivot point 112 to assist in lifting the frame. The guide link 148 and control link 152 cause forward movement of the pin 130 in the slot 114 as well as counterclockwise rotation of the rear support lever 128 about the pin 130. Simultaneously, the bed lock plate is caused to rotate in a clockwise direction by the actuating arm 156 and front support lever 116 thereby extending the center legs 50 by means of the center leg actuating arm 164. The position shown in FIG. 6 is generally a counterbalanced position. The body section is then permitted to drop toward the floor with the center leg 50 being fully extended to support the partially folded frame in that position shown in FIG. 5. The operator then grasps the front tubular member 58 to rotate the intermediate section forwardly about pivot 82. When the lock 84 engages the pilot section angle 40 and intermediate section angle 42 further movement of the tube 58 causes the bell crank 180 to rotate in a counterclockwise direction extending the front leg 52 through the bell crank actuating arm 174 and front leg actuating arm 170. Front leg 52 pivots around rivet 53 until fully extended. At this point, the leg is in a vertical disposition with the foot section being disposed horizontally. The four sections thus are unfolded to form a horizontal sleeping surface.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. In a foldable sofa-sleeper bed frame adapted to be mounted upon a sofa frame having back and side members and a stationary front rail which defines a storage enclosure, said bed frame comprising pivotally interconnected head, body, intermediate and foot sections each having a pair of opposed side rails adapted to support a fabric and mattress, and a pair of center legs each connected to a center actuating arm movable to retract and extend said center legs, said bed frame being movable between a retracted position in which said bed frame is contained within said storage enclosure of said sofa frame and said center actuating arms retract said center legs, and an extended position in which said bed frame extends forwardly over said front rail and said center actuating arms extend said center legs to form a bed, the improvement comprising:

a U-shaped cross brace having opposed legs and an elongate tube connected between and extending substantially transverse to said legs, each of said legs being pivotally connected at one end to one of said side rails and having a pin at the other end;

said cross brace being pivotal from a first position in which said legs are disposed in a plane substantially transverse to said side rails and said fabric with said bed frame in an extended position, to a second position in which said legs are disposed in a plane substantially parallel to said side rails and fabric with said bed frame in a retracted position;

opposed pivoting arms formed with a slot at one end having a forward and rearward end, each of said pivoting arms being connected to one of said center actuating arms and being movable therewith, said slotted end of each of said pivoting arms receiving said pin of one of said legs of said U-shaped cross brace, said pins being movable between said forward and rearward ends of said slots with the movement of said pivoting arms as said bed frame moves from an extended position to a retracted position, said pivoting arms pivoting said U-shaped cross brace between said first and second positions.

* * * * *